US010595610B2

(12) United States Patent
Son et al.

(10) Patent No.: US 10,595,610 B2
(45) Date of Patent: Mar. 24, 2020

(54) PUMPING-TYPE COSMETIC CONTAINER HAVING METAL APPLICATOR

(71) Applicant: YONWOO CO., LTD., Incheon (KR)

(72) Inventors: Su-Jin Son, Incheon (KR); Min-Goo Kim, Incheon (KR); Jung-yeon Seo, Incheon (KR)

(73) Assignee: YONWOOD CO., LTD., Incheon (KR)

( * ) Notice: Subject to any disclaimer, the term of this patent is extended or adjusted under 35 U.S.C. 154(b) by 0 days.

(21) Appl. No.: 16/064,130

(22) PCT Filed: Oct. 21, 2016

(86) PCT No.: PCT/KR2016/011876
§ 371 (c)(1),
(2) Date: Jun. 20, 2018

(87) PCT Pub. No.: WO2017/115990
PCT Pub. Date: Jul. 6, 2017

(65) Prior Publication Data

US 2019/0000209 A1 Jan. 3, 2019

(30) Foreign Application Priority Data

Dec. 28, 2015 (KR) ..... 10-2015-0187665

(51) Int. Cl.
*A45D 33/12* (2006.01)
*A61H 15/02* (2006.01)
(Continued)

(52) U.S. Cl.
CPC ..... *A45D 33/12* (2013.01); *A45D 34/00* (2013.01); *A45D 34/04* (2013.01); *A45D 34/041* (2013.01); *A61H 15/02* (2013.01); *B65D 47/00* (2013.01); *B65D 47/04* (2013.01); *B65D 47/42* (2013.01); *B65D 83/00* (2013.01); *A45D 2200/056* (2013.01); *B05B 11/00412* (2018.08); *B05B 11/00416* (2018.08); *B05B 11/3001* (2013.01); *B05B 11/3023* (2013.01); *B05B 11/3074* (2013.01)

(58) Field of Classification Search
CPC ..... A45D 33/12; A45D 34/041; A45D 40/261
See application file for complete search history.

(56) References Cited

U.S. PATENT DOCUMENTS 8,757,914 B1 * 6/2014 Megaro ..... A45D 34/041 401/219
2010/0239356 A1 * 9/2010 Caulier ..... A45D 34/041 401/157

(Continued)

FOREIGN PATENT DOCUMENTS

JP 4637189 B2 2/2011
KR 20-0235849 10/2001

(Continued)

OTHER PUBLICATIONS

International Search Report issued in PCT/KR2016/011876 dated Feb. 20, 2017.

*Primary Examiner* — J C Jacyna
(74) *Attorney, Agent, or Firm* — Marshall, Gerstein & Borun LLP

(57) ABSTRACT

A pumping-type cosmetic container having a metal applicator, in which it is possible that an applicator made of a metal material is coupled to a front part of a button member, such that the contents can be applied through the applicator immediately after contents are discharged through a pumping operation. The warmth or cold can be delivered to the skin during the application of the contents to the skin through the applicator made of the metal material, thereby enabling facial skin metabolism to be promoted and skin elasticity to improve.

1 Claim, 10 Drawing Sheets

A - A'

(51) Int. Cl.

| | |
|---|---|
| ***B65D 83/00*** | (2006.01) |
| ***B65D 47/00*** | (2006.01) |
| ***B65D 47/42*** | (2006.01) |
| ***A45D 34/00*** | (2006.01) |
| ***A45D 34/04*** | (2006.01) |
| ***B65D 47/04*** | (2006.01) |
| *B05B 11/00* | (2006.01) |

(56) References Cited

U.S. PATENT DOCUMENTS

| | | | | |
|---|---|---|---|---|
| 2011/0091265 | A1 | 4/2011 | Zhang | |
| 2013/0344254 | A1* | 12/2013 | King | A45D 40/261<br>427/428.18 |
| 2014/0234004 | A1* | 8/2014 | Thorpe | A45D 34/04<br>401/1 |
| 2015/0108173 | A1* | 4/2015 | Kim | B05B 11/3015<br>222/321.8 |
| 2015/0201735 | A1* | 7/2015 | Swaile | A45D 40/261<br>401/266 |
| 2016/0058156 | A1* | 3/2016 | Chiasson | A45D 40/24<br>132/200 |

FOREIGN PATENT DOCUMENTS

| | | | |
|---|---|---|---|
| KR | 20-0442230 | Y1 | 10/2008 |
| KR | 2012-0054715 | A | 5/2012 |
| KR | 2015-0073232 | A | 7/2015 |

* cited by examiner

PUMPING-TYPE COSMETIC CONTAINER HAVING METAL APPLICATOR

BACKGROUND OF THE INVENTION

The present invention relates to a pumping-type cosmetic container having a metal applicator, the container wherein it is possible that an applicator made of a metal material is coupled to a front part of a button member, such that the contents can be applied through the applicator immediately after contents are discharged through a pumping operation, and besides, the warmth or cold can be delivered to the skin during the application of the contents to the skin through the applicator made of the metal material, thereby enabling facial skin metabolism to be promoted and skin elasticity to improve.

Generally, pumping type cosmetics containers are configured in that a pumping member is disposed at the upper portion of the container body and thereby contents can be discharged to the outside by means of pumping operation of a pumping means. This pumping-type cosmetic container is disclosed in FIG. 1 of the registered utility model No. 20-0235849 02358459 (Hereafter is called as the registered utility model).

Referring to the registered utility model in the above, conventional pumping-type cosmetic containers comprises a container part (3) storing contents and a pumping part (1) coupled to an upper end of the container part (3) and discharging the contents stored in the container part (3), wherein the pumping part (1) includes a cap coupled to the upper end of the container part (3) and a button (50) coupled to the cap capable of being lifted and lowered and formed with a discharge outlet (53) at the interior therein, wherein at the interior of the cap is provided a housing (10) downwardly extending to the contents filled in the container part (3), and are respectively provided a piston rod (20) and a seal cap (30) connected to a stem (57) at the lower portion of the button (50) and discharging the contents flowing to the housing (10) while being lifted at the interior of the housing (10). Furthermore, a contents inflow hole (11) opened and closed by a ball (70) is provided at the lower end portion of the housing (10) and a spring (80) upwardly supporting the piston rod (20) between the contents inflow hole (11) and the piston rod (20).

However, the registered utility model with the above constitution is configured to discharge contents simply by means of pumping operation of the pumping part (1). Therefore, due to absence of the means for applying the discharged contents over the skin, a user should have a separate applicator to apply contents over the skin, thereby leading to user inconvenience.

SUMMARY OF THE INVENTION

The present invention is devised to solve the problems described in the above, the objectives of the present invention is to provide a pumping-type cosmetic container having a metal applicator which can apply contents, by coupling the metal applicator at the front surface of a button member, through the applicator after discharging the contents through pumping operation, and also can deliver warmth and coldness to the skin when applying the contents through the metal applicator.

To solve the problems in the above, a pumping-type cosmetic container having a metal applicator according to the present invention includes: a container body where contents are stored; a pumping member coupled to the upper portion of the container body and discharging the contents stored in the container body by means of pumping operation; a fixation body coupled as encasing the pumping member at the upper portion of the container body, and fixing the pumping member to the upper portion of the container body; and a button member disposed at the upper portion of the pumping member, and delivering pressure to the pumping member according to a user's pressurization, and inducing the pumping operation, characterized in that a discharge outlet is formed such that contents can be discharged to the outside, in that a securing part is provided at the inner side of the discharge outlet such that an applicator, made of metal, applying contents onto skin can be secured, and in that a contents movement hole is formed at the bottom surface of the securing part such that the contents moving to the upper portion thereof through pumping operation of the pumping member can move to the discharge outlet.

Furthermore, a pumping-type cosmetic container having a metal applicator according to the present invention includes: a container body storing contents; a pumping member coupled to the upper portion of the container body and discharging the contents stored in the container body by means of pumping operation; a fixation body coupled as encasing the pumping member at the upper portion of the container body, and fixing the pumping member to the upper portion of the container body; and a button member disposed at the upper portion of the pumping member, and delivering pressure to the pumping member according to a user's pressurization, and inducing the pumping operation, wherein a fixation part is protrusively formed at the front surface of the button part such that an applicator applying contents onto skin can be fixed, and wherein an applicator, made of metal and equipped with an applying surface, is coupled to the fixation part so as to apply the contents discharged to the outside onto skin, characterized in that a discharge hole is formed at the applying surface of the applicator such that contents can be discharged to the outside, in that a contents movement hole is provided at the fixation part such that the contents moving to the upper portion thereof through pumping operation of the pumping member can move to the discharge outlet of the applicator.

Furthermore, it is characterized in that at the inner side of the fixation body is provided a rotation-preventing tube extending to the upper portion thereof so as to prevent rotation of the button member, and in that at the outer side of the rotation-preventing tube is provided a plurality of rotation-preventing protrusions formed with a predetermined distance apart along the outer circumferential surface thereof.

Furthermore, it is characterized in that at the inner side of the button member is provided a plurality of coupling protrusions which is coupled to a space formed between a plurality of the rotation-preventing protrusions and prevents rotation of the button member.

As described in the above, according to the present invention, it is possible that an applicator made of a metal material is coupled to a front part of a button member, such that the contents can be applied through the applicator immediately after contents are discharged through a pumping operation, and besides, the warmth or cold can be delivered to the skin during the application of the contents to the skin through the applicator made of the metal material, thereby enabling facial skin metabolism to be promoted and skin elasticity to improve.

DETAILED DESCRIPTION OF PREFERRED EMBODIMENTS

Figure 1:
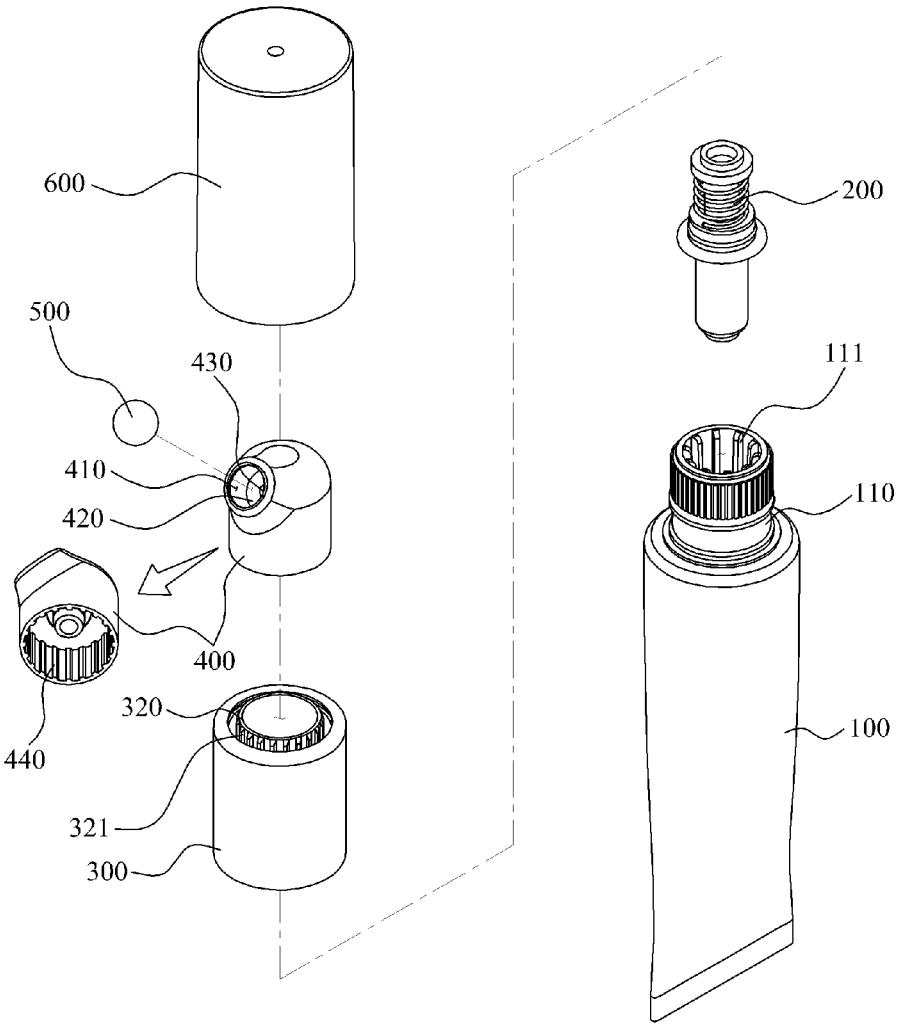
FIG. 1 is an exploded perspective view illustrating a configuration of a pumping-type cosmetic container having a metal applicator according to the first exemplary embodiment of the present invention.

Hereinafter, the present invention will be described in detail with reference to the accompanying drawings. The same reference numerals provided in the drawings indicate the same members.

Figure 2:
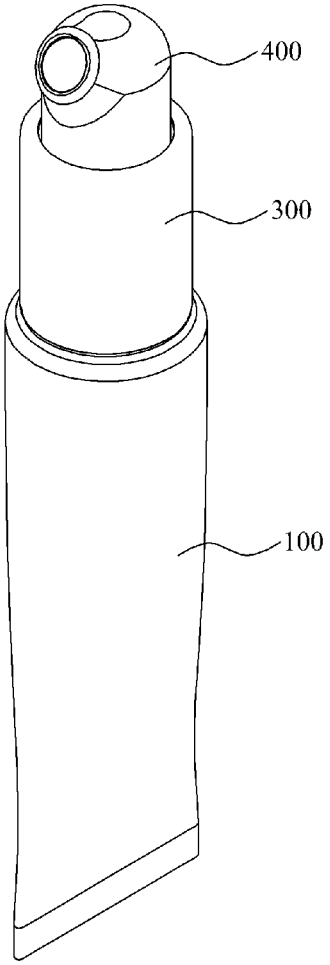
FIG. 2 is an assembled perspective view illustrating a configuration of a pumping-type cosmetic container having a metal applicator according to the first exemplary embodiment of the present invention.
Figure 3:
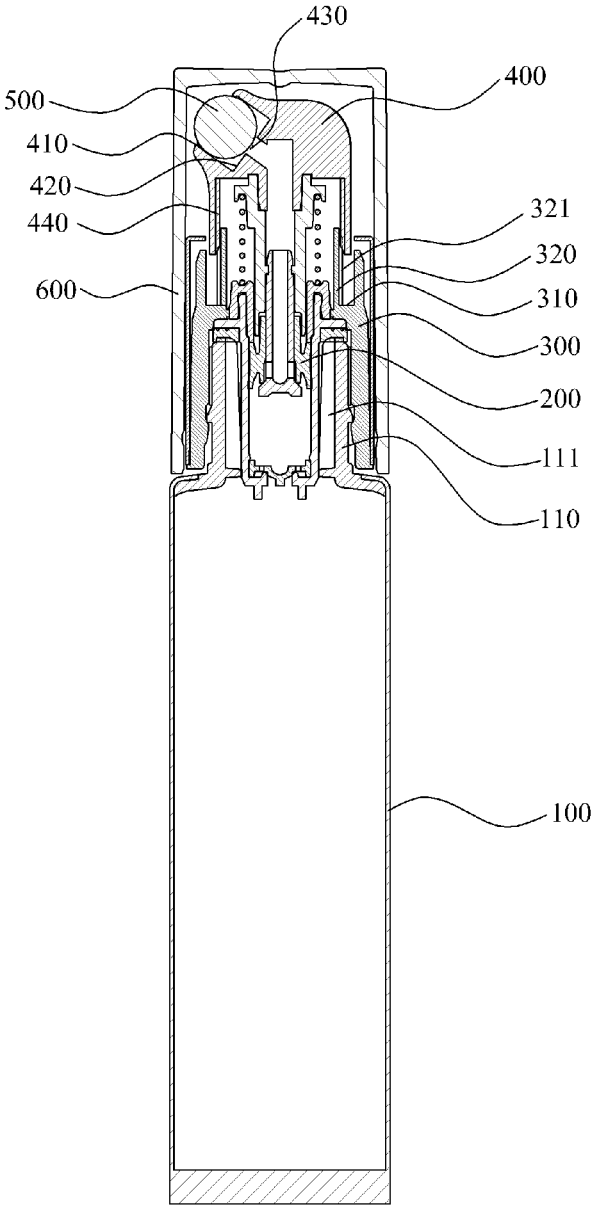
FIG. 3 is an assembled cross-sectional view illustrating a configuration of a pumping-type cosmetic container having a metal applicator according to the first exemplary embodiment of the present invention.

FIG. 1 is an exploded perspective view illustrating a configuration of a pumping-type cosmetic container having a metal applicator according to the first exemplary embodiment of the present invention. FIG. 2 is an assembled perspective view illustrating a configuration of a pumping-type cosmetic container having a metal applicator according to the first exemplary embodiment of the present invention. FIG. 3 is an assembled cross-sectional view illustrating a configuration of a pumping-type cosmetic container having a metal applicator according to the first exemplary embodiment of the present invention.

Referring to FIGS. 1 to 3, a pumping-type cosmetic container having a metal applicator according to the first exemplary embodiment of the present invention includes a container body 100, a pumping member 200, a fixation body 300, a button member 400, and an applicator 500.

The container body 100, where contents are stored, is provided with a discharge part 110 at an upper portion thereof such that contents can be discharged, wherein at the inner circumferential surface of the discharge part 110 is provided a supporting protrusion 111 which is tightly coupled as encasing the outer circumferential surface of the pumping member 200 and prevents movement of the pumping member 200.

Figure 9:
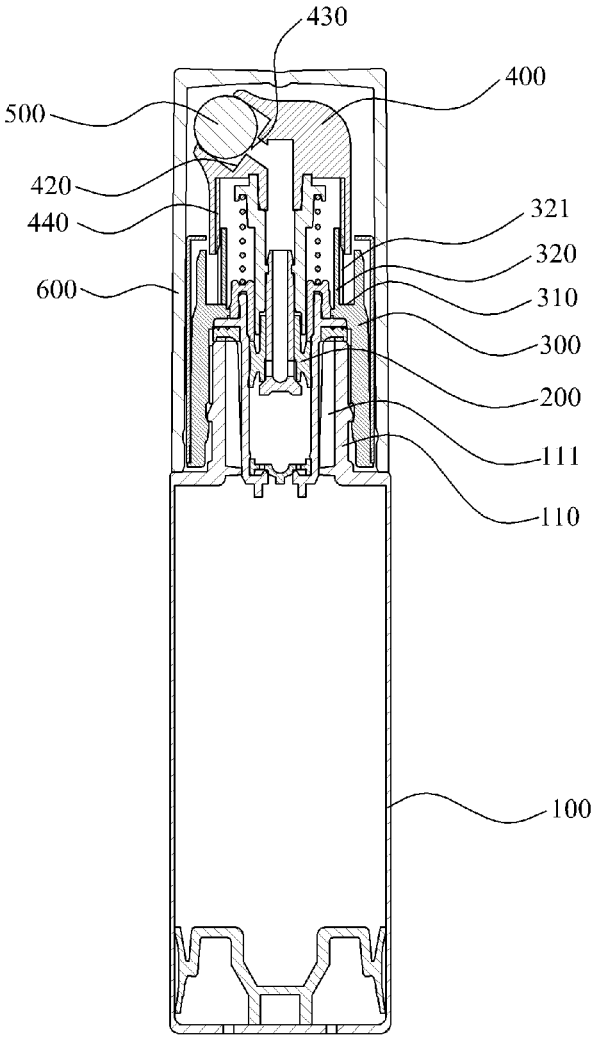
FIGS. 9 and 10 are assembled cross-sectional views of a pumping type of cosmetics container equipped with a side button according to the third and the fourth exemplary embodiments of the present invention.
Figure 10:
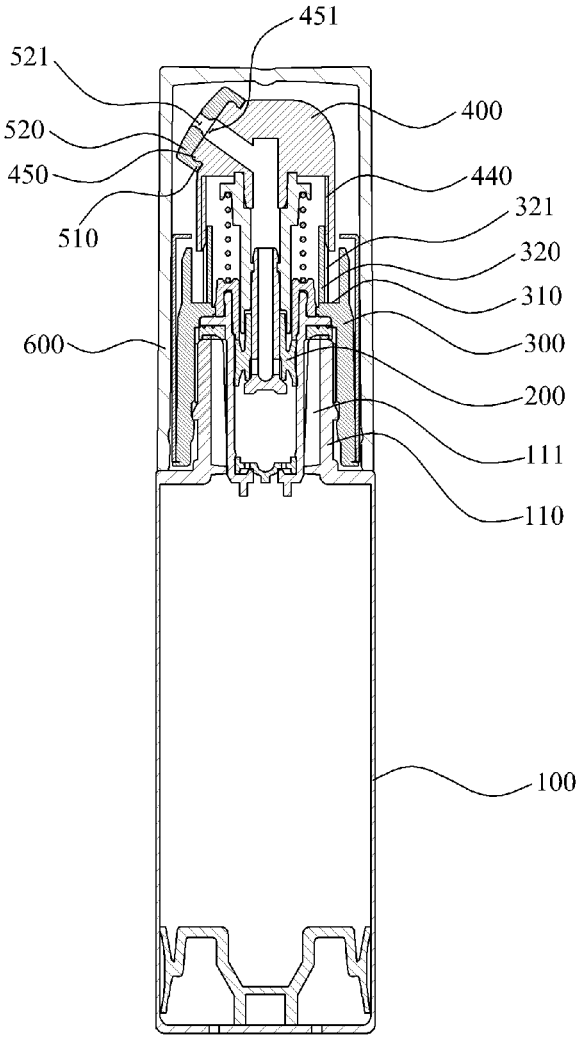

The container body 100 can be constituted as a tube container which discharges contents by its deformation according to user's pressurization, and as illustrated in FIGS. 9 and 10, can also be constituted as a container equipped with a piston at the inner side thereof.

The pumping member 200, coupled to the upper portion of the container body 100 and discharging contents stored in the container body 100 through pumping operation, is considered to be a prior art in the field of the present invention; therefore, detailed description will be omitted.

The fixation body 300, coupled as encasing the pumping member 200 at the upper portion of the container body 100 and fixing the pumping member 200 to the upper portion of the pumping member 200, encases the inner circumferential surface thereof and is formed with a fixing projection 310 to be able to fix the pumping member 200.

The present invention is characterized in that at the inner side of the fixation body 300 is provided a rotation-preventing tube 320 which extends toward the upper portion thereof from the fixing projection 310 to prevent a button member 400 from being rotated. At the outer side of the rotation-preventing tube 320 is provided a plurality of rotation-preventing protrusions 321 with predetermined distance apart along the outer circumferential surface thereof, wherein, as a coupling protrusion 440 of the button member 400 is coupled to a space formed between a plurality of rotation-preventing protrusions, the plurality of rotation-preventing protrusions 321 prevents the button member 400 from being rotated when a user applies contents onto the skin through the applicator 500.

Meanwhile, an over cap 600, detachably coupled as encasing a button member 400 and an applicator 500, is provided at the outer side of the fixation body 300.

The button member 400, which is disposed at the upper portion of the pumping member 200, delivers pressure to the pumping member 200 according to user's pressurization, and induces pumping operation, is formed with a discharge outlet 410 at the front surface such that contents can be discharged to the outside by the pumping operation.

The present invention is characterized in that a securing part 420 is provided at the inner side of the discharge outlet 410 such that an applicator 500 applying contents onto skin can be secured. By securing an applicator 500 with a sphere-shaped ball to the securing part 420, after discharging contents through pumping operation of the pumping member 200, it is possible to apply contents by means of the very ball applicator 500 and to massage the skin at the same time.

A contents movement outlet 430 is provided at the bottom surface of the securing part 420 such that the contents moving to the upper portion thereof through pumping operation of the pumping member 200 can move to the discharge outlet 410.

Meanwhile, the present invention is characterized in that at the inner side of the button part 400 is provided a plurality of coupling protrusions 440 which is coupled to a space formed between a plurality of the rotation-preventing protrusion 321 and prevents the button member 400 from being rotated. The coupling protrusions 440 encase the inner circumferential surface of the button member 400 and are formed with a predetermined distance apart and coupled to the space formed between the plurality of rotation-preventing protrusions 321. Due to this, the coupling protrusions 440 are supported by the rotation-preventing protrusions 321, and thereby, can prevent the button member 400 from being rotated when a user applies contents onto skin through the applicator 500.

The applicator 500, installed at the securing part 420 of the button member 400, tightly contacted to a user's skin and discharging contents onto the skin, is composed of a sphere-shaped ball applicator 500, a part of which is exposed to the outside of the discharge outlet 410 so as to be contacted to the user's skin.

The present invention is characterized in that the applicator 500 is made of metal, such that it is possible not only to apply contents but to deliver warmth or coldness onto the skin when applying contents onto the skin, thereby promoting the metabolism of skin and improving elasticity of the skin.

Hereafter, with reference of FIGS. 4A and 4B, a using method of a pumping-type cosmetic container having a metal applicator according to the first exemplary embodiment of the present invention will be explained.

Figure 4A:
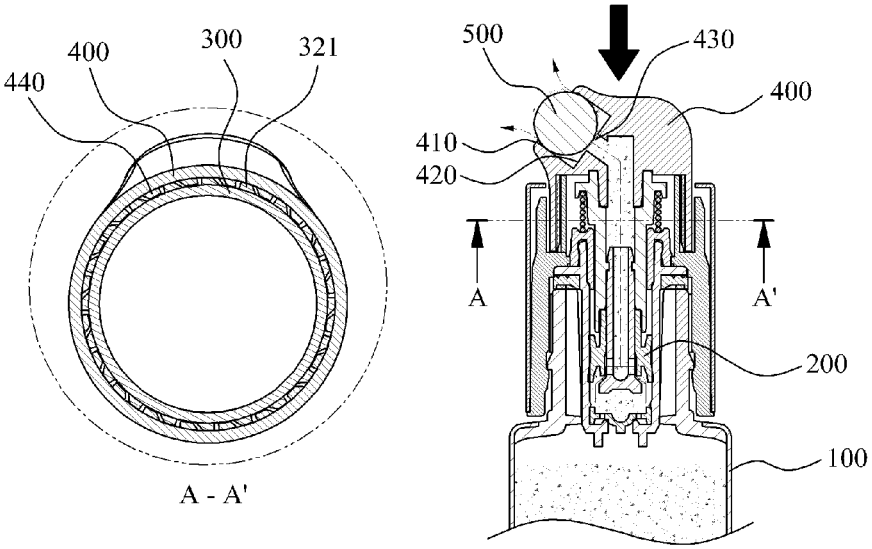
FIGS. 4A and 4B are explanatory view applicator illustrating a using method of a pumping-type cosmetic container having a metal according to the first exemplary embodiment of the present invention.
Figure 4B:
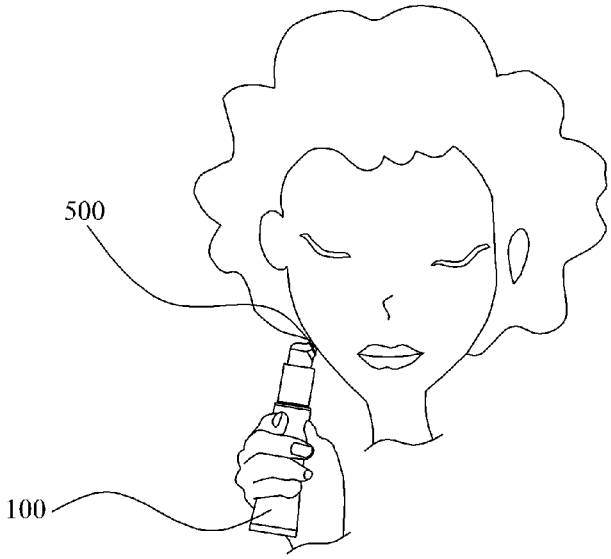

Referring FIGS. 4A and 4B, a pumping member 200 performs pumping operation when the button member 400 is pressurized, and the contents having been stored in the container body 100 are passed through a contents movement hole 430 and discharged to the outside through a discharge outlet 410. At this, it is possible to apply the contents onto the skin and simultaneously to provide massage the skin by means of an applicator 500 installed at an securing part 420 which is equipped at the inner side of the discharge outlet 410.

As in the above, when the contents are applied onto the skin through the applicator 500, a button member 400 can be rotated by pressure according to the contact of the skin with the applicator 500. However, as illustrated in the enlarged view (A-A' cross-sectional view) showing the coupling relationship of a fixation body 300 and the button member 400, a rotation-preventing protrusion 321 of the fixation body 300 and the coupling protrusion 440 of the button member 400 are configured to be interlocked each other, such that the button member 400 is prevented from being rotated, thereby smoothly applying the contents onto the skin.

Hereafter, referring FIGS. 5 to 7, a pumping-type cosmetic container having a metal applicator according to the second exemplary embodiment of the present invention will be described.

Figure 5:
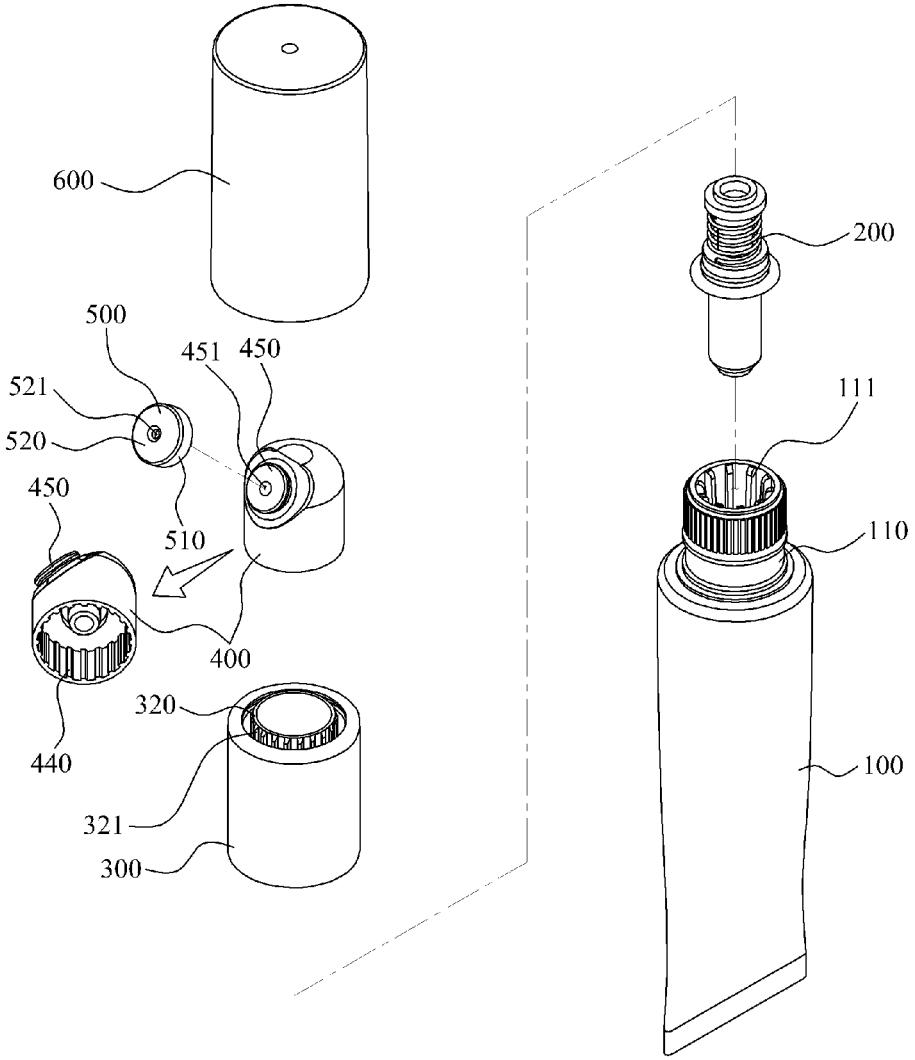
FIG. 5 is an exploded perspective view illustrating a configuration of a pumping-type cosmetic container having a metal applicator according to the second exemplary embodiment of the present invention.
Figure 6:
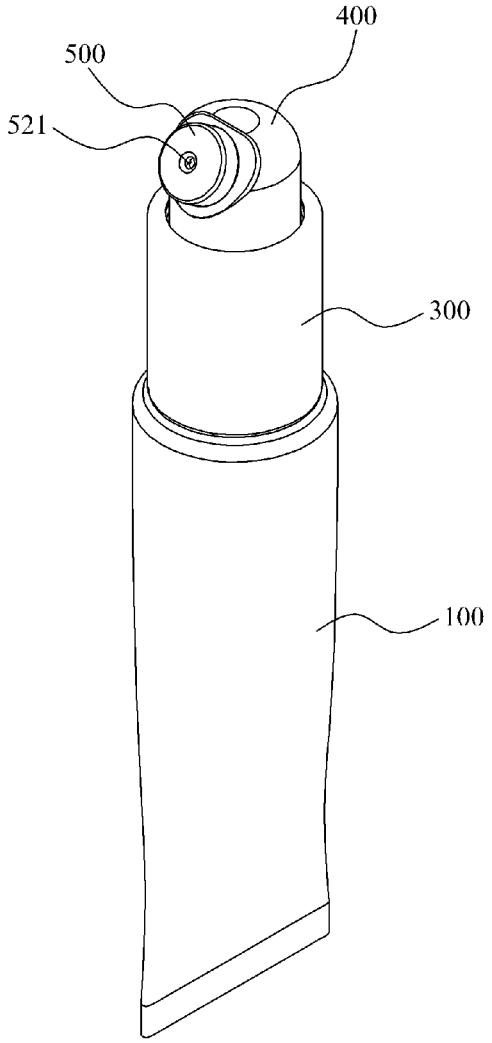
FIG. 6 is an assembled perspective view illustrating a configuration of a pumping-type cosmetic container having a metal applicator according to the second exemplary embodiment of the present invention.
Figure 7:
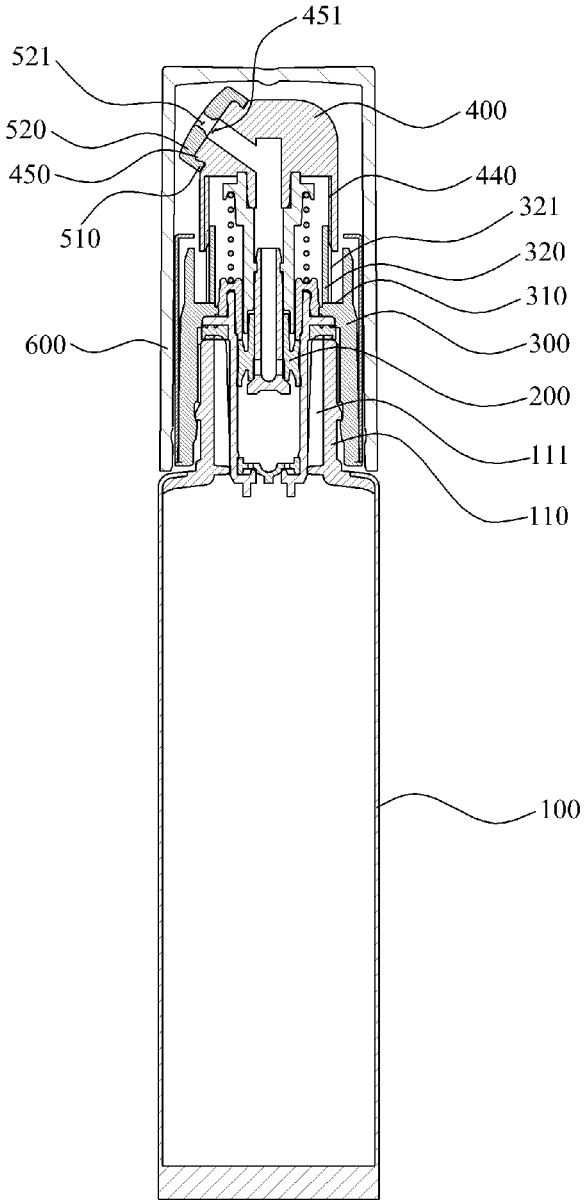
FIG. 7 is an assembled cross-sectional view illustrating a configuration of a pumping-type cosmetic container having a metal applicator according to the second exemplary embodiment of the present invention.

Referring FIGS. 5 to 7, a pumping-type cosmetic container having a metal applicator according to the second exemplary embodiment of the present invention includes a container body 100, a pumping member 200, a fixation body 300, a button member 400, and an applicator 500. The container body 100, the pumping member 200 and the fixation body 300 have the same configuration and functions, as described in the second exemplary embodiment of the present invention; therefore, only a button member 400 and an applicator 500 will be described hereafter.

It is characterized in that a button member 400 according to the second exemplary embodiment of the present invention is configured to have a fixation part 450 protrusively formed such that it is possible for an applicator 500 which applies contents onto the skin to be fixedly installed at the front surface thereof. A contents movement hole 451 is formed at the center portion of the fixation part 450 such that the contents moving to the upper portion thereof by pumping operation of the pumping member 200 can be moved to a discharge hole 521 of the applicator 500.

Since a coupling protrusion 440 equipped at the inner side of the button member 400 is the same in structure and function as described above in the first exemplary embodiment of the present invention, a detailed description thereof will be omitted.

Meanwhile, according to the second exemplary embodiment of the present invention, the applicator 500 coupled to the fixation part 450 of the button member 400 is contacted to a user's skin and applies contents on the skin. The applicator 500 comprises: a coupling unit 510 coupled as encasing the fixation part 450 and fixing the applicator 500 to the button member 400; and an application surface 520 contacted to the user's skin and applying the contents to the user's skin, wherein a discharge hole 521 is formed at the application surface 520 such that the contents can be discharged to the outside.

The applicator 500, by being coupled to the fixation part 450 provided on the front surface of the button member 400, discharges the contents through the discharge hole 521 by the pumping operation of the pumping member 200, and then applies the contents onto the skin through the application surface 520 and provides a massage function at the same time.

In addition, the applicator 500 is characterized to be made of a metal material as in the first exemplary embodiment, such that it is possible to apply not only the contents but also coldness or warmth to the skin when the contents are being applied to the skin, thereby promoting metabolism of the facial skin and improving elasticity of the skin.

Hereafter, referring FIGS. 8A and 8B, a using method of a pumping-type cosmetic container having a metal applicator according to the second exemplary embodiment of the present invention will be described.

Figure 8A:
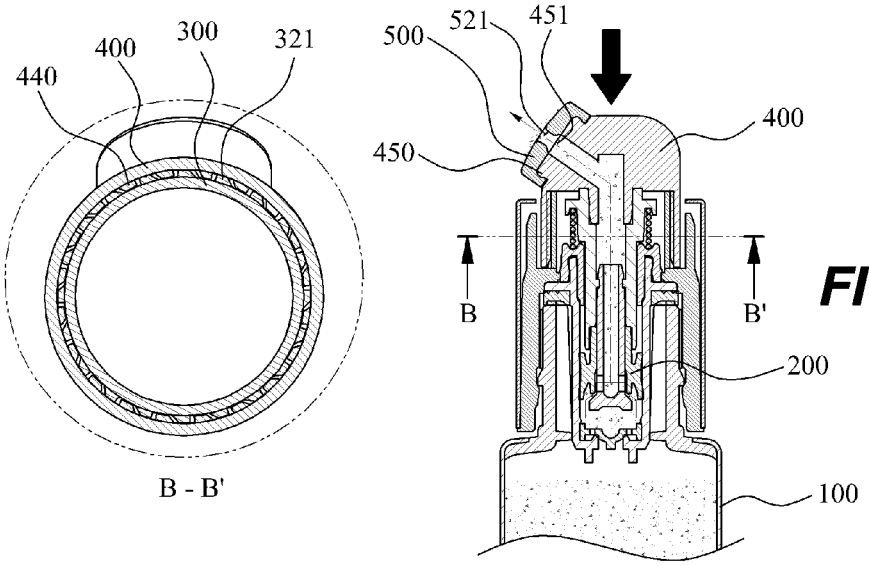
FIGS. 8A and 8B are an explanatory view illustrating a using method of a pumping-type cosmetic container having a metal according to the second exemplary embodiment of the present invention.
Figure 8B:
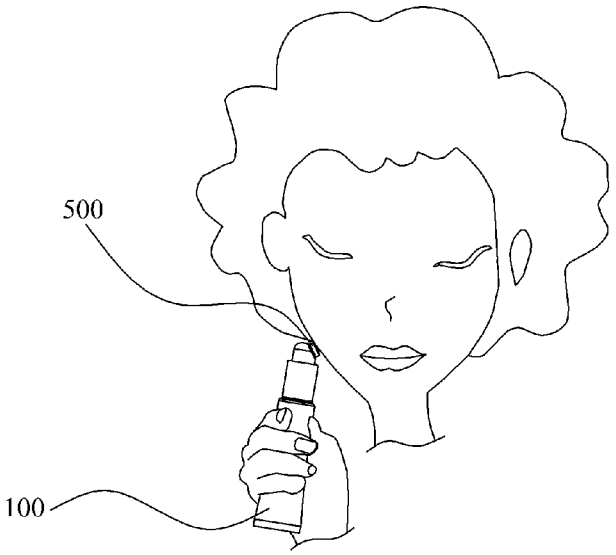

Referring FIGS. 8A and 8B, the present invention is configured in that the pumping operation of the pumping member 200 is performed when the button member 400 is pressurized, and the contents having been stored in the container body 100 are passed the contents movement hole 451 and discharged to the outside through the discharge hole 521. In this case, the contents can be applied onto the skin through the applicator 500 coupled to the fixation part 450, and a massage function can be provided at the same time.

When the contents are applied to the skin through the applicator 500 as described in the above, the button member 400 can be rotated by the pressure due to the contact of the skin with the applicator 500. As shown in the enlarged view (A-A' cross-sectional view) which illustrates the coupling relationship of the fixation body 300 and the button member 400, the rotation-preventing protrusion 321 of the fixation body 300 and the coupling protrusion 440 of the button member 400 are coupled with each other such that the button member 400 is prevented from being rotated and the contents can be smoothly applied to the skin.

As previously described in the above, the structure of the button part in the present invention can be changed so as to install the metal applicator at the front surface of the button part of a pumping-type cosmetic container. after discharging the contents through pumping operation according to pressurization of the button part, it is possible to apply contents through the applicator installed at the very front surface of the button part and to provide the massage function at the same time.

As described above, optimal embodiments have been disclosed in the drawings and the specification. Although specific terms have been used herein, these are only intended to describe the present invention and are not intended to limit the meanings of the terms or to restrict the scope of the present invention as disclosed in the accompanying claims. Therefore, those skilled in the art will appreciate that various modifications and other equivalent embodiments are possible from the above embodiments. Therefore, the technical protective scope of the present invention should be defined by the technical of idea of accompanied claims.

What is claimed is:

1. A pumping-type cosmetic container having a metal applicator, comprising:

a container body where contents are stored;

a pumping member coupled to the upper portion of the container body and discharging the contents stored in the container body by a pumping operation;

a fixation body coupled as encasing the pumping member at the upper portion of the container body, and fixing the pumping member to the upper portion of the container body; and a button member disposed at the upper portion of the pumping member, and delivering pressure to the pumping member according to user's pressurization, and inducing the pumping operation, wherein a discharge outlet is formed such that contents can be discharged to the outside, a securing part is provided at the inner side of the discharge outlet such that an applicator, made of metal, applying contents onto skin can be secured, and a contents movement hole is formed at the bottom surface of the securing part such that the contents moving to the upper portion thereof through pumping operation of the pumping member can move to the discharge outlet, wherein at the inner side of the fixation body is provided a rotation-preventing tube extending to the upper portion thereof so as to prevent rotation of the button member, and at the outer side of the rotation-preventing tube is provided a plurality of rotation-preventing protrusions formed with a predetermined distance apart along the outer circumferential surface thereof, wherein at the inner side of the button member is provided a plurality of coupling protrusions coupled to a space formed between a plurality of the rotation-preventing protrusions and prevents rotation of the button member.

* * * * *